US011519188B2

(12) United States Patent
Haeberle et al.

(10) Patent No.: US 11,519,188 B2
(45) Date of Patent: Dec. 6, 2022

(54) HOLDER FOR HOLDING A RAILING COMPONENT ON A CEILING FORMWORK PANEL

(71) Applicant: PERI SE, Weissenhorn (DE)

(72) Inventors: Wilfried Haeberle, Langenau (DE); Thomas Raudies, Ehingen (DE)

(73) Assignee: PERI SE, Weissenborn (DE)

( * ) Notice: Subject to any disclaimer, the term of this patent is extended or adjusted under 35 U.S.C. 154(b) by 0 days.

(21) Appl. No.: 16/827,375

(22) Filed: Mar. 23, 2020

(65) Prior Publication Data

US 2020/0299978 A1 Sep. 24, 2020

(30) Foreign Application Priority Data

Mar. 22, 2019 (DE) ..... 10 2019 107 461.4

(51) Int. Cl.
*E04G 17/00* (2006.01)
*E04G 11/38* (2006.01)
(Continued)

(52) U.S. Cl.
CPC ..... *E04G 17/002* (2013.01); *E04G 5/14* (2013.01); *E04G 11/50* (2013.01); *E04G 17/042* (2013.01);
(Continued)

(58) Field of Classification Search
CPC ... E04G 11/50; E04G 11/38; E04G 2007/285; E04G 17/002; E04G 11/36; E04G 21/3223; E04G 2011/067; E04G 5/14; E04G 5/144; E04G 5/147; E04G 2005/148; E04G 17/042; E04G 17/045
(Continued)

(56) References Cited

U.S. PATENT DOCUMENTS 6,038,829 A * 3/2000 Franks ..... E04G 3/26 52/645
6,516,955 B1 * 2/2003 Dudhwala ..... A47B 47/0008 211/182
(Continued)

FOREIGN PATENT DOCUMENTS

CN 201043354 4/2008
CN 104989118 10/2015
(Continued)

*Primary Examiner* — Michael Safavi
(74) *Attorney, Agent, or Firm* — Wei & Sleman LLP

(57) ABSTRACT

A holder for holding an object on a formwork panel, in particular for holding a railing component on a ceiling formwork panel, wherein the holder is configured for being affixed to the formwork panel, and the formwork panel has two longitudinal edge supports and two transverse edge supports, wherein the holder has a first arm that is configured for engaging with a longitudinal edge support of the formwork panel and a second arm that extends transverse to the first arm, forms an angle space together with the first arm, and is configured for engaging with a transverse edge support, wherein the first arm has a first projection for being introduced into an opening of the longitudinal edge support on its side facing the angle space, and the second arm has a second projection for being introduced into an opening of the transverse edge support on its side facing the angle space.

20 Claims, 5 Drawing Sheets

(51) Int. Cl.

| | |
|---|---|
| ***E04G 5/14*** | (2006.01) |
| ***E04G 11/50*** | (2006.01) |
| ***E04G 17/04*** | (2006.01) |
| *E04G 7/28* | (2006.01) |
| *E04G 11/06* | (2006.01) |

(52) U.S. Cl.
CPC ..... *E04G 17/045* (2013.01); *E04G 11/38* (2013.01); *E04G 2007/285* (2013.01); *E04G 2011/067* (2013.01)

(58) Field of Classification Search
USPC ..... 403/170
See application file for complete search history.

(56) References Cited

U.S. PATENT DOCUMENTS

| | | | | |
|---|---|---|---|---|
| 6,892,503 | B1 * | 5/2005 | Kang | E04H 15/34 403/170 |
| 7,341,391 | B2 * | 3/2008 | Nakahori | F16B 7/0426 403/27 |
| 10,501,942 | B2 | 12/2019 | Palasek | |
| 2004/0041141 | A1 * | 3/2004 | Cannon | E04G 21/3223 256/65.05 |
| 2005/0193646 | A1 * | 9/2005 | Malenfant | E04G 21/3223 52/146 |
| 2008/0006809 | A1 * | 1/2008 | Stoffels | E04G 21/3223 256/67 |
| 2018/0112413 | A1 | 4/2018 | Palasek | |

FOREIGN PATENT DOCUMENTS

| | | | | |
|---|---|---|---|---|
| CN | 205758155 | | 12/2016 | |
| DE | 9410303 | U1 * | 10/1995 | E04G 5/041 |
| DE | 202018004724 | U1 | 11/2018 | |
| EP | 1683930 | A2 | 7/2006 | |
| EP | 2757212 | A1 | 7/2014 | |
| ES | 2270686 | B1 | 1/2008 | |
| FR | 2925546 | A1 * | 6/2009 | E04G 21/3233 |
| NL | 1023831 | C2 | 1/2005 | |
| WO | WO-2007068231 | A1 * | 6/2007 | E04G 1/38 |
| WO | 2017178460 | A1 | 10/2017 | |

* cited by examiner

HOLDER FOR HOLDING A RAILING COMPONENT ON A CEILING FORMWORK PANEL

FIELD OF THE INVENTION

The object of the invention is a holder for holding an object on a formwork panel, in particular for holding a railing component on a ceiling formwork panel, wherein the holder is configured for being affixed to the formwork panel, and the formwork panel has two longitudinal edge supports and two transverse edge supports.

BACKGROUND OF THE INVENTION

Holders that are configured on a ceiling formwork panel for holding a railing component are known. The known holders are rather heavy, complicated constructions. Transport of the holder to the location of the construction site, where it is to be affixed to the formwork panel, is accordingly complicated.

SUMMARY OF THE INVENTION

The problem addressed by the invention is that of providing an improved holder for holding an object on a formwork panel.

This problem is solved by a holder for holding an object on a formwork panel, in particular for holding a railing component on a ceiling formwork panel, wherein the holder is configured for being affixed to the formwork panel, and the formwork panel has two longitudinal edge supports and two transverse edge supports, characterized in that the holder has a first arm that is configured for engaging with a longitudinal edge support of the formwork panel and a second arm that extends transverse to the first arm, forms an angle space together with the first arm, and is configured for engaging with a transverse edge support, wherein the first arm has a first projection for being introduced into an opening of the longitudinal edge support on its side facing the angle space, and the second arm has a second projection for being introduced into an opening of the transverse edge support on its side facing the angle space; and that the holder has a movement mechanism with which the projection of one of the two arms can be moved in the direction toward the other of the two arms, so as to tighten the holder.

According to the invention, a holder is proposed for holding an object on a formwork panel, in particular for holding a railing component on a ceiling formwork panel, wherein the holder is configured for being affixed to the formwork panel, and the formwork panel has two longitudinal edge supports and two transverse edge supports, wherein the holder has a first arm that is configured for engaging with a longitudinal edge support of the formwork panel, and a second arm that extends transverse to the first arm, forms an angle space together with the first arm, and is configured for engaging with a transverse edge support, wherein the first arm has a first projection for being introduced into an opening of the longitudinal edge support on its side facing the angle space, and the second arm has a second projection for being introduced into an opening of the transverse edge support on its side facing the angle space; and wherein the holder has a movement mechanism with which the projection of one of the two arms can be moved in the direction toward the other of the two arms, so as to tighten the holder.

In comparison, the holder according to the invention is a comparatively light, inexpensive product having a simple structure. The holder according to the invention can be easily transported from place to place at the construction site, and can be installed very easily, even by just one person. For affixing the holder to a formwork panel, first one of the two arms can be set onto one of the edge supports of the formwork panel. Afterward, the other arm can be set onto the other edge support of the formwork panel, which support runs toward the same corner of the formwork panel as the previously mentioned edge support. This can be done by means of a pivoting movement of the holder. Alternatively, this can be done by means of activating the movement mechanism. Affixing the holder is concluded in that the movement mechanism is tightened, whereby at least in the case of one arm, the projection is tightened against the outer edge of the opening into which the projection has been introduced.

The holder according to the invention can additionally be characterized in that the movement mechanism is configured in such a manner that the projection of the said one arm can be moved relative to this one arm, using the mechanism, or can be configured in such a manner that the said one arm can be moved together with the projection, using the mechanism.

The holder according to the invention, as it is disclosed in the previous part of the description, can additionally be characterized in that the projection of the said one arm and/or the projection of the other arm is/are configured as a rear engagement projection, for engaging behind the edge of the opening into which it is introduced. Using this measure, the affixing process is particularly simple, because the rear engagement projection, which has already been brought partway into the rear engagement position, leads to the result that the holder can no longer drop away from the formwork there, and therefore can be held more easily until the movement mechanism has been tightened completely. Furthermore, a rear engagement projection increases the security of engagement with the relevant edge support of the formwork panel.

The holder according to the invention, as it has been disclosed in the previous part of the description, can additionally be characterized in that at least one of the two arms has a further projection for engaging with the relevant edge support, wherein the projection of this arm, mentioned in the first paragraph, and the further projection of this arm are provided at longitudinal positions of this arm that are spaced apart from one another. With this configuration, torque support of this arm in the affixed state is achieved. Torques that attempt to rotate this arm relative to the assigned edge support of the formwork panel are effectively carried away.

The further projection can be provided for being introduced into an opening of this arm, wherein this opening is simultaneously the opening of this arm mentioned in the first paragraph or a further opening of this arm. If this opening is simultaneously the opening mentioned in the first paragraph, it must have such a length that the projection mentioned in the first paragraph and the further projection can both be introduced into this opening. It is pointed out that other possibilities of creating torque support also exist. In one embodiment of the invention, the further projection is a projection that lies against the lower edge of the relevant edge support.

The holder according to the invention, as it has been disclosed in the previous part of the description, can additionally be characterized in that the first projection and/or the second projection has/have a region on its side facing away from the free end of the relevant arm, in such a manner that this region is at least roughly adapted to the outer edge of the opening into which it is to be introduced. In this manner, the surface pressure between the relevant projection and the outer edge of the opening into which the projection is to be introduced can be reduced. This also reduces wear at this location. The said region can be rounded off, and the counter-region of the opening can be rounded off.

There are embodiments of the holder in which the movement mechanism is a screw-thread mechanism or a wedge mechanism. These mechanisms are uncomplicated and can be easily activated by the person working them. In the following, in the example section of the description, concrete movement mechanisms of this type will be shown and described.

The holder according to the invention, as it has been disclosed in the previous part of the description, can additionally be characterized in that the arm, which can be moved by means of the movement mechanism, is connected with the remainder of the holder by way of a slanted-surface guide, in such a manner that tightening of the movement mechanism additionally forces this arm to perform a movement that is directed transverse to the longitudinal expanse direction of this arm. In this manner, the projections of the two arms mentioned in the first paragraph are both automatically tightened in the direction toward the angle vertex of the holder when the movement mechanism is tightened. This results in particularly convenient affixing of the holder, in particular if both said projections are configured as rear engagement projections.

The first arm and the second arm can be tubular over the majority of their length, preferably in the form of a square tube.

The holder according to the invention can have a railing post or a device for affixing a railing post integrated into it. In this way, a railing can be affixed to a ceiling formwork panel in an extremely simple manner.

A further object of the invention is a railing arrangement on a ceiling formwork, characterized in that it has at least one railing holder as it has been disclosed in the previous part of the description, and multiple securing elements having a longitudinal expanse one on top of the other. Guard rails, intermediate rails, and so-called toe boards are mentioned as concrete securing elements; see also the exemplary embodiments below. The railing arrangement can have multiple railing holders according to the invention, wherein in most cases, the securing elements span at least the distance between two adjacent railing holders.

The railing arrangement according to the invention can additionally be characterized in that the at least one railing holder has a tubular component into which a railing post is pushed with part of its length, and that at least a partial number of the securing elements is held on the railing post. In this way, the holder according to the invention makes very convenient assembly of the railing possible, for one thing, but still remains a light product that is easy to handle.

A typical field of use for the holder according to the invention is fastening a railing along the edge of a ceiling formwork. After the forms for a concrete ceiling to be poured have been put in place (i.e. the ceiling formwork panels for the ceiling have been set up on formwork supports), a railing must normally be set up along the edge of the ceiling formwork so that persons working on the ceiling formwork can work without danger, for example when installing steel reinforcement mats. However, the holder according to the invention can also be used for other purposes. An example that can be mentioned is the possibility of holding a rotating deflection roller for a pull rope at a formwork panel corner. Then a filled bucket of mortar can be pulled upward to a higher level of the building under construction, using the pull rope deflected up there. A further example is holding tarps that hang down vertically from the building edge as wind protection.

A further object of the invention is an arrangement that has a formwork panel having two longitudinal edge supports and two transverse edge supports, characterized in that the arrangement furthermore has a holder affixed on it, as it has been described in the previous part of the description.

The formwork panel mentioned in connection with the invention can be a formwork panel for pouring concrete. However, the term "formwork panel" is also supposed to comprise other formwork panels, for example those for supporting earth banks and those for underpinning areas for repair work below a building ceiling.

BRIEF DESCRIPTION OF THE DRAWINGS

The invention and more specific embodiments of the invention will be explained in greater detail below, using exemplary embodiments shown in drawings. These show.

DETAILED DESCRIPTION

When the terms "bottom/below" and "top/above" are used in the following, this relates to a spatial position of the holder in which its two arms lie in a horizontal plane.

Figure 1:
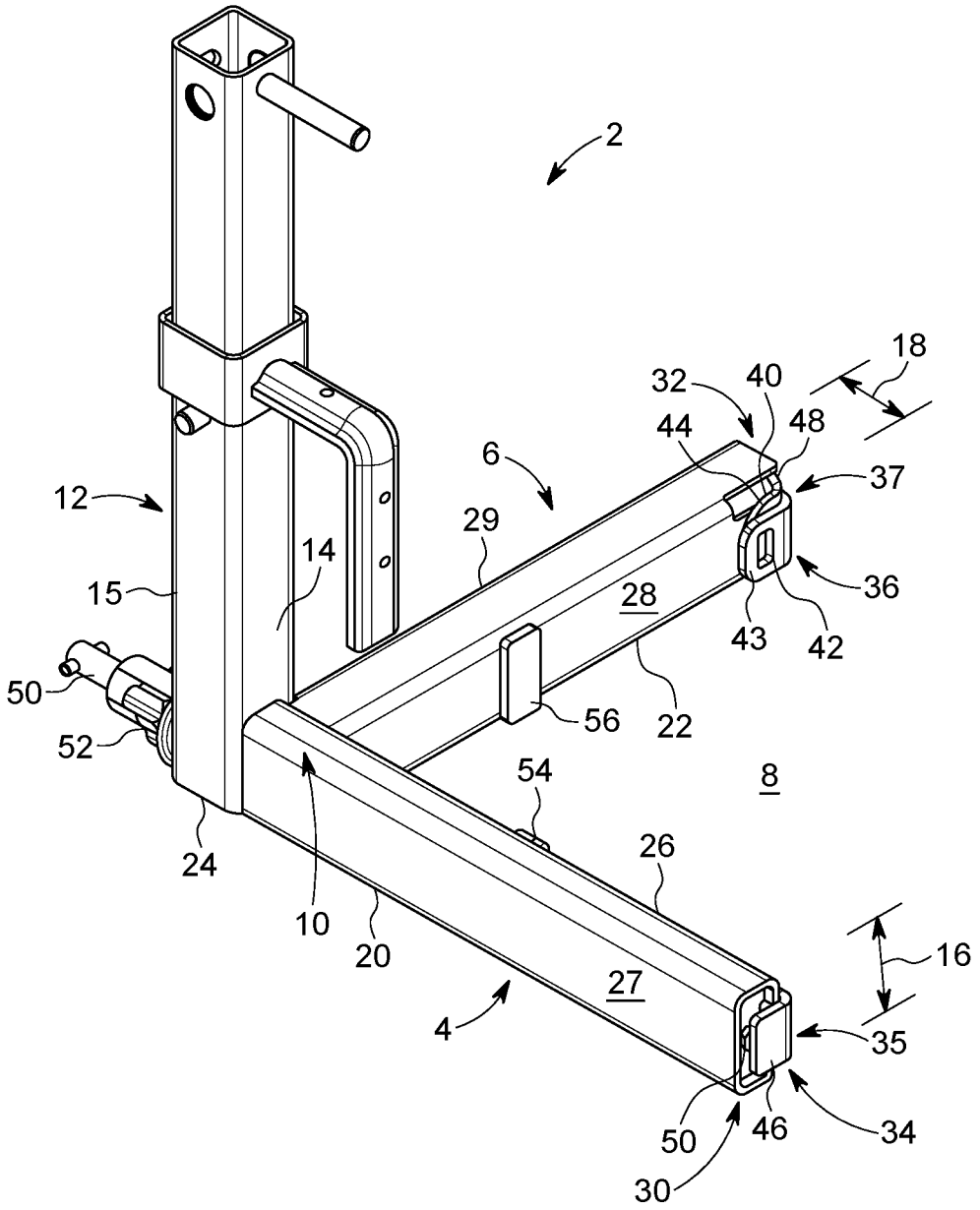
FIG. 1 a first exemplary embodiment of a holder, in a perspective view.

The holder 2 shown in FIG. 1 has a first arm 4 (which goes in a direction from top left to bottom right in FIG. 1) and a second arm 6 (which goes from bottom left to top right in FIG. 1). The second arm 6 is set onto an end region of the first arm 4 at the side, with one of its end faces, so that the two arms 4 and 6 form two shanks of a right angle and form an angle space 8 between them. The region where the two arms 4 and 6 come together is called the vertex 10.

The holder 2 furthermore has a railing holder 12 arranged at a right angle to the common plane of the first arm 4 and the second arm 6. The vertex-side end face of the first arm 4 stands against a side surface 14 of the railing holder 12 in the end region of the railing holder 12, which is the bottom end region in FIG. 1. The end region of an outer side surface 29 (i.e. a side surface that faces away from the angle space 8) of the second arm 6 also lies against the side surface 14 of the railing holder 12. In the case of each of the three components 4, 6, 12, the main part is structured as a square tube made of steel, having rounded-off corners. The cross-sectional shapes of the three components 4, 6, 12 are somewhat different from one another. The first arm 4 and the second arm 6 have a rectangular cross-section—somewhat different from one another—having a height 16 that is somewhat greater than their width 18. In the case of the railing holder 12, the cross-section is square with rounded-off corners.

The three said components 4, 6, 12 are welded to one another to form a stable unit. If one lays the holder 2 down onto a level substrate with the undersides 20 and 22 of the two arms 4 and 6, respectively, and with the lower end face 22 of the railing holder 12, the said two undersides 20 and the said lower end face 22 lie in a common plane.

The second arm 6 has a second projection 36 in the region of its free end 32 on the side 28 that faces the angle space 8 (i.e. the end at a distance from the vertex 10), which projects away there as compared with the remainder of the second arm 6. The second projection 36 is part of an element 37 that is angular, in total, and has been produced separately and then welded onto the second arm 6. In the case of the second projection 36, it is possible to distinguish a first region 40 directly next to the side surface 28 of the second arm 6, and a second region 42 that is at a distance from the side surface 28 of the second arm 6. The first region 40 has the shape of an essentially semicircular plate, the circumferential edge surface 44 of which is essentially rounded in the form of a semicircle on the side facing the vertex 10 or the side facing away from the free end 32. The second region 42 is also plate-shaped, and parallel to the side surface 28 of the second arm 6 for part of its length, measured in the longitudinal direction of the second arm 6, wherein there, the clear distance between the second region 42 and the side surface 28 of the second arm 6 corresponds to the thickness of the plate-shaped first region 40. The second region 42 goes beyond the first region 40 of the projection 36 in its end region 43 that faces the vertex 10, so that the second region 42 can engage behind part of the outer edge of an opening in an edge support of a formwork panel with this end region, as will be described in greater detail below. The end region 43 is set at a slight slant relative to the side surface 28 of the second arm 6, so that the clear distance from the side surface 28 is slightly greater, at the end of the end region 43, than the thickness of the first region.

In the region of the free end 30 (i.e. the end farther away from the vertex 10) of the first arm 4, a first projection 34 is provided, which is configured, in principle, very similar to the second projection 36 that has already been described, and also possesses a first region 40, a second region 42, and an end region 43. The first projection 34 is also part of a separately produced element 35, but this element is not welded onto the first arm 4 at the free end 30. Instead, the element 35 is a separate component that is built in so as to move relative to the first arm 4, in the longitudinal direction of this arm. For this purpose, there is a guide between the first arm 4 and the element 35, which cannot be explicitly seen in FIG. 1. The element 35 has a region 46 that is bent away at a right angle and extends in plate shape transverse to the longitudinal expanse direction of the first arm 4. A threaded rod 50 is attached at this region 46, which rod passes through the hollow first arm 4 lengthwise. Only the far right end of the threaded rod 50 can be seen in FIG. 1, which end is attached to the region 46 of the first projection 34; the other end can be seen at the far left. The threaded rod 50 passes through the railing holder 12 in two bores. On the side 15 of the railing holder 12 that faces away from the free end 30 of the first arm 4, a nut 52 that can be turned by hand is screwed onto the threaded rod 50. The nut 52 supports itself against the side 15 of the railing holder 12 with its one end face. By turning the nut 52, the threaded rod 50 and, with it, the first projection 34 can thereby be moved in the longitudinal direction of the first arm.

Furthermore, it can be seen in FIG. 1 that the first arm 4 has a first further projection 54 on its inner side 26 that faces the angle space 8, and that the second arm 6 has a second further projection 56 on its inner side 28 that faces the angle space 8. The two further projections 54 and 56 are each welded onto the inner side 26 or 28, respectively, and have the shape of an upright rectangular plate. The first further projection 54 is situated at a location that is located between the vertex 10 and the free end 30 of the first arm 4. The second further projection 56 is situated at a location that is located between the vertex 10 and the free end 32 of the second arm 6.

Figure 6:
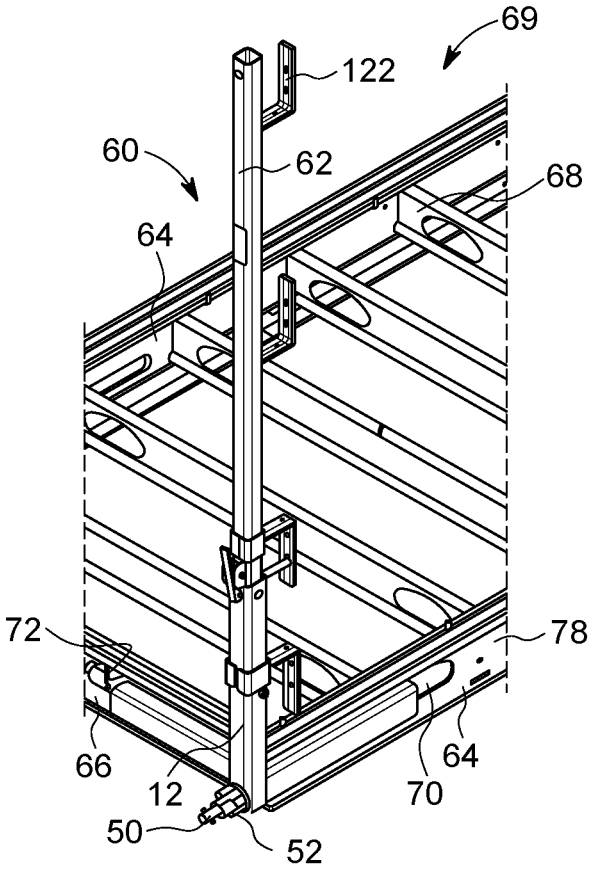
FIG. 6 a holder together with a railing post, which holder is affixed to a formwork panel, in a perspective representation with a view at a slant from above and the outside, onto the formwork panel corner.
Figure 7:
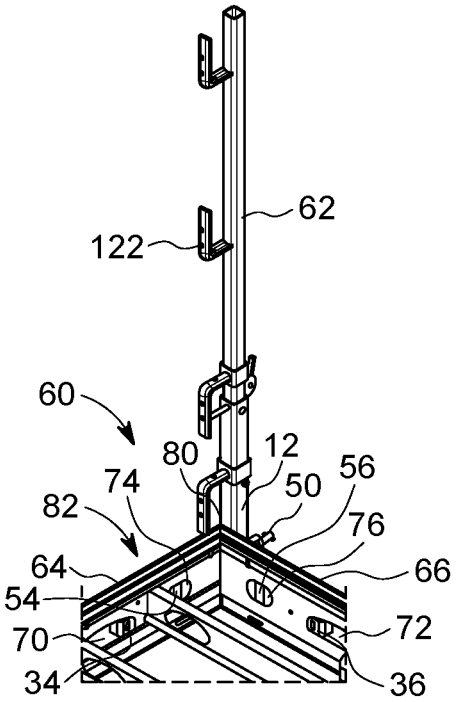
FIG. 7 the holder with the railing post of FIG. 6, in a perspective representation, and now with a view at a slant from above and the inside, into the formwork panel corner.

In FIGS. 6 and 7, one can see the situation after the holder 2 of FIG. 1 has been affixed to a formwork panel 60, in this case a ceiling formwork panel. For the purpose of better visibility of the details of this affixing, the formwork panel 60 is shown without its formwork shell. The formwork shell side of the frame 82 of the formwork panel 60 faces upward in FIGS. 6 and 7. A formwork shell affixed to the frame 82 would completely cover the "interior" of the formwork panel 60.

For the sake of brevity, only the term "panel 60" will be used in the following instead of the term "formwork panel 60."

In FIGS. 6 and 7, the holder 2 according to the invention is shown in a state in which the railing holder 12 has been telescopically pushed into a railing post 62 with part of its length. The railing post 62 has a hollow-square cross-section that is slightly smaller than the hollow-square cross-section of the railing holder 12.

The frame 82 of the panel 60 essentially consists of two longitudinal edge supports 64, two transverse edge supports 66, and a number of transverse intermediate supports 68. These components are welded to one another.

In FIG. 6, the viewing direction with which the observer looks at FIG. 7 is shown with the arrow 69.

At some distance from each frame corner 80, each longitudinal edge support 64 has an elongated opening 70 that passes through it. Each transverse edge support 66 also has an elongated opening 72 that passes through it at some distance from each frame corner 80. To state it more precisely, the openings 70 and 72 are each situated in the crosspiece of the relevant edge support 64 or 66, in terms of height between a front widened region of the relevant edge support 64 or 66, on the formwork shell side, and a rear widened region of the relevant edge support 64 or 66. The openings 70 and 72 have the same shape. This shape can be described as having an essentially straight-line delimitation in the lower region in FIG. 6, a large-radius delimitation in the upper region in FIG. 6, and an essentially semicircular delimitation in the regions in between, which are the longitudinal ends of the opening 70 and 72, respectively.

In FIG. 7, it can be seen that in the finished, installed state of the holder 2 that is shown, each of the projections 34 and 36 partly sits in the relevant opening 70 or 72, respectively, and partly engages behind the outer edge of the opening with the rear engagement region 43. In the case of each projection 34 and 36, the rounded edge surface 44 lies against the rounded outer edge surface of the relevant opening 70 or 72 in the end region of the opening 70 or 72. The radii of rounding of the first region 40 of the relevant projection 34 or 36, on the one hand, and of the opening end region, on the other hand, essentially coincide with one another.

In FIG. 7, it can furthermore be seen that a further opening 74 or 76 is provided in the side wall 26 or 28, respectively, in the region between the respective opening 70 or 72 that has been described and the corner 80 of the frame 82 of the panel 60, both in the case of the relevant longitudinal edge support 64 and in the case of the relevant transverse edge support 66. Each of the further openings 74 and 76 has the shape of an oval that is delimited in a straight line in the center region and in the shape of a semicircle at the two ends. The first further projection 54 of the first arm 4 sits in the further opening 74; the second further projection 56 of the second arm 6 sits in the further opening 76. The further openings 74 and 76 have the same configuration and have a height that is only slightly greater than the height of the further projections 54 and 56, so that the further projections 54 and 56 fit into the further openings 74 and 76 with only slight play, in terms of height.

It can furthermore be seen that the two arms 4 and 6 lie against the outer side of the crosspiece 78 of the relevant edge support 64 or 66 with their inner sides 26 and 28, over their full area. Thereby the holder 2 has a very firm hold on the panel 60, for one thing, and for another brings about reinforcement of the panel 60 in that corner region where it is affixed to the panel 60.

For affixing the holder 2 to the corner region of a panel 60, first the first projection 34 of the first arm 4 is "moved out," in other words moved in the direction away from the vertex 10 by means of the threaded rod 50. Then the second arm 6 is moved toward the transverse edge support 66 in a slanted position (in which the vertex 10 is at a slight distance from the corner 80 of the frame 82 of the panel 60), leading with the second projection 36. The second projection 36 is introduced into the opening 72 to such an extent that the second region 42 of the second projection 36 comes into a position on the inside of the crosspiece 78 of the transverse edge support 66. Now the second arm 6 is displaced in terms of its longitudinal direction or in the longitudinal direction of the transverse edge support 66, while at the same time, the vertex 10 is moved to pivot relative to the corner 80 of the frame 82 of the panel 60. During this movement, the further projection 56 gets into the further opening 76. The rear engagement region 43 of the second projection 36 is now situated on the inside of the material of the crosspiece 78, next to the opening 72, as can be seen in FIG. 7.

During the course of the movement of the vertex 10 to the corner 80 of the frame 82, the first projection 34 and the further projection 54 go into the openings 70 and 74 of the longitudinal edge support 64. Now the nut 52 is tightened, and thereby the first projection 34 is pulled in the direction toward the vertex 10. The end region 43 of the second region 42 of the first projection 34 comes into the rear engagement position shown in FIG. 7, in which it engages behind the outer edge of the opening 70 in the region that lies closest to the corner 80. The nut 52 is tightened. Now the rounded edge surface 44 of the first projection 34 also lies against the end region of the outline of the opening 70 that lies closest to the corner 80.

The further projections 54 and 56 bring about torque support on both arms 4 and 6 in combination with the first projection 34 and the second projection 36. If, for example in FIG. 7, a force is exerted on the upper end of the railing holder 12 to the right front, parallel to the longitudinal expanse of the transverse edge support 66, this torque is carried away by the pair of the projections 36 and 56. The same holds true accordingly with regard to the pair of the projections 34 and 54 if a force directed to the right rear is exerted on the end of the railing holder 12, for example in FIG. 7, parallel to the longitudinal expanse of the longitudinal edge support 64.

Alternative to the exemplary embodiment of FIG. 1, 6, 7, the arms 4 and 6 can be slightly longer, and the further projections 54 and 56 can be shaped and placed in such a manner that in the affixed state of the holder 2, they go into the same opening 70 or 72, in each instance, as the first region 40 of the projection 34 or 36, in each instance, although at a location that is at a slightly greater distance from the vertex 10. The torque support described is achieved with this embodiment, as well.

It should be emphasized that the further projections 54 and 56 do not necessarily have to be provided. After all, the first arm 4 and the second arm 6 are captured, so to speak, between the upper and lower widened regions of the edge supports 64 and 66 described above. Furthermore, the railing holder 12 for the height of the frame 82 lies against the relevant transverse edge support 66. It is thereby possible to leave out only one of the further projections 54 and 56 or even both further projections 54 and 56.

Furthermore, it should be emphasized that embodiments of the holder 2 are possible, in which the first projection 34 and/or the second projection 36 are configured without a rear engagement region 43. In this regard, it is possible to structure the first region 40 to be slightly thicker than in FIG. 1, 6, 7, with the remainder of the geometry remaining the same. The first region 40 continues to be part of the element 35 or 37.

If only the first projection 34, for example, has a rear engagement region 43, but the second projection 36 is configured without a rear engagement region 43, the method of procedure can be as follows in affixing the holder 2 to the panel 60, for example: The first projection 34 is "moved out," as described above. The first arm 4 is laid against the outer side of an edge support 64 or 66, wherein the first projection 34 comes into the opening 70 and the further projection 54 comes into the opening 74. In this phase, the second arm 6 is situated parallel to the other edge support 66 or 64, wherein, however, its inner side 28 is still removed from the crosspiece 78 of the other edge support 66 or 64 at least for the thickness of the second projection 36 and for the thickness of the further projection 56 (because otherwise, it would not be at all possible to bring the first arm 4 against the outer side of the edge support 64 or 66). Now the first projection 34 is moved in the direction toward the second arm 6 or in the direction toward the vertex 10 by means of the movement mechanism, threaded rod 50 and nut 52, until its first region 40 comes against the region of the opening outer edge that is close to the vertex, and its rear engagement region 43 comes into the rear engagement position. By means of this activation of the movement mechanism, the second arm 6 is simultaneously pulled against the other edge support 66 or 64, making contact, wherein its projections 36 and 56 come into the openings 72 and 76.

If both the first projection 34 and the second projection 36 are configured without a rear engagement region 43, affixing the holder 2 to the panel 60 can be carried out in the same manner as described in the preceding paragraph.

Instead of the movement mechanism shown in FIG. 1, in the form of threaded rod 50 and nut 52, a wedge mechanism can be provided, for example. In this case, the rod 50 does not have a screw thread, and has an oblong hole in the region that is situated to the left rear of the railing holder 12 in FIG.

1, which hole passes through the rod 50, and the longitudinal direction of which hole coincides with the longitudinal expanse direction of the rod 50. It is possible to insert a wedge through this oblong hole, and the rod 50 is pulled to the left and upward in FIG. 1 by hammering the wedge in.

Figure 2:
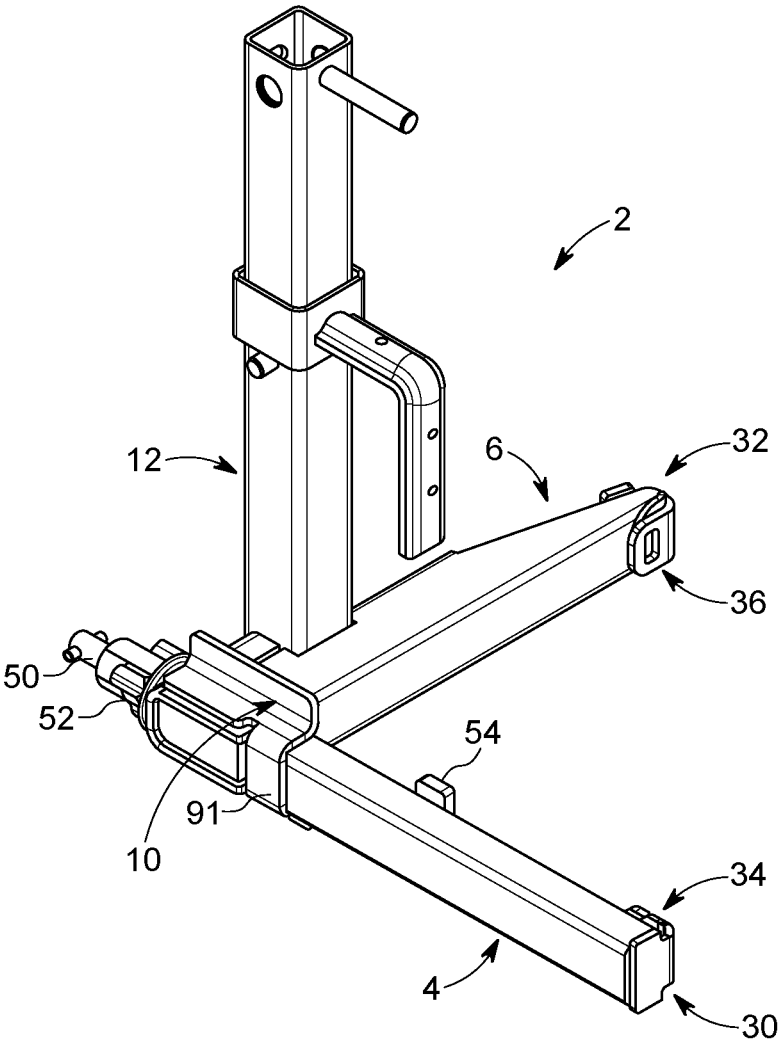
FIG. 2 a second exemplary embodiment of a holder, in a perspective view.
Figure 3:
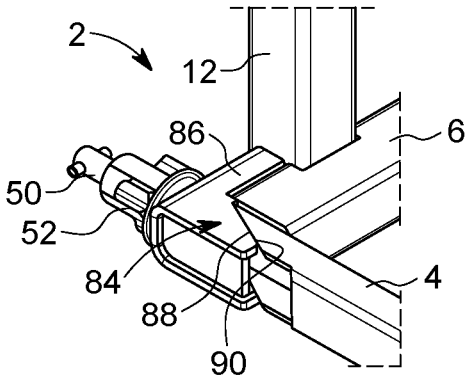
FIG. 3 a part of the holder of FIG. 2, but after removal of a holder component so as to provide a clear view of a design detail.

In the exemplary embodiment of FIGS. 2 and 3, a slanted-surface guide 84 is provided in the region of the vertex 10. The slanted-surface guide 84 possesses a first slanted surface 88 that runs from the top left to the bottom right in FIG. 3, on a component 86 that is affixed to the outer side 29 of the second arm 6 in the end region of the second arm 6 on the vertex side. Interacting with the first slanted surface 88, the first arm 4 possesses a second slanted surface 90, which lies against the first slanted surface 88 over its full area, and also runs from top left to bottom right in FIG. 3. Each of the two slanted surfaces 88 and 90 is composed, to state it precisely, of two partial slanted surfaces, specifically a partial surface on each of the upper wall and the lower wall of the component 86 or of the first arm 4, in each instance.

In contrast to FIG. 1, the railing holder 12 is affixed to the second arm 6 at a slight distance from the vertex 10. Furthermore, the second arm 6 does not have a further projection 56.

In the case of the exemplary embodiment of FIGS. 2 and 3, the first projection 34 is firmly welded onto the free end 30 of the first arm 4, and the second projection 36 is also still firmly welded onto the free end 32 of the second arm 6. The configuration of the two projections 34 and 36, with a first region 40, a second region 42, rounded edge surface 44, and rear engagement function of the projections 34 and 36, is the same as in the case of the exemplary embodiment of FIG. 1. The same holds true analogously also for the further projection 54 on the first arm 4, wherein, however, it must now be taken into consideration that the further projection 54—measured in the longitudinal direction of the first arm 4—must be so short, i.e. the opening 74—measured in the same direction—must be so long that the further projection 54 has sufficient freedom of movement in the opening 74 when the first arm 4 moves toward the vertex 10 in its longitudinal direction when the holder 2 is tightened.

In the case of the exemplary embodiment of FIGS. 2 and 3, the threaded rod 50 is not directly connected with the first projection 34, but rather attached to the first arm 4 on the inner side. Thus, the first arm 4 together with the first projection 34 is moved in the direction toward the vertex 10 or in the direction toward the second arm 6 by tightening the nut 52.

By means of the slanted-surface guide 84 that is shown and described, a movement of the arm 4 in the longitudinal direction of the second arm 6 or transverse to the longitudinal expanse of the first arm 4 necessarily accompanies this longitudinal movement of the first arm 4. By tightening the nut 52, therefore both the first projection 34 and the second projection 36 are moved in the direction toward the vertex 10. Therefore affixing the holder 2 to the panel 60 is facilitated.

The slanted-surface guide 84 exposed in FIG. 3 is normally situated behind an encompassing component 91 that is shown in FIG. 2. The encompassing component 91 is firmly welded onto both the second arm 6 and the component 86; it protects the slanted-surface guide 84, guides the first arm 4 during its longitudinal movement, and creates a rigid connection between the first arm 4 and the second arm 6.

Figure 4:
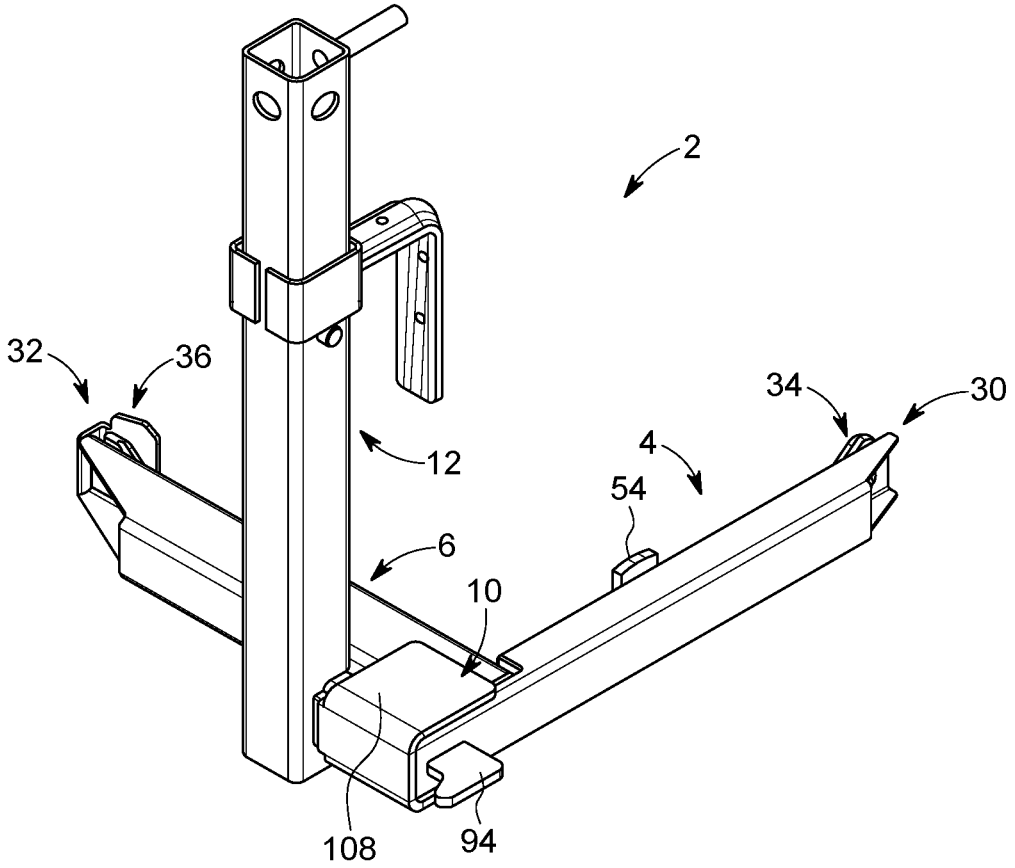
FIG. 4 a third exemplary embodiment of a holder, in a perspective view.
Figure 5:
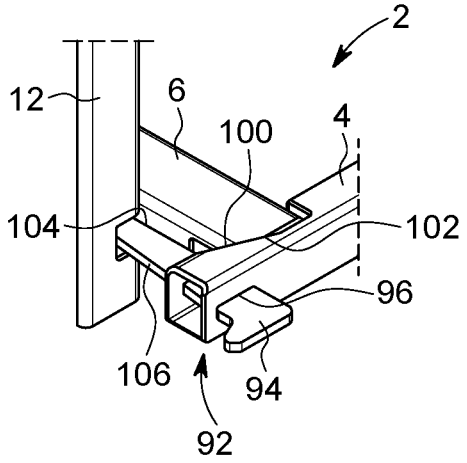
FIG. 5 a part of the holder of FIG. 4, after removal of a holder component so as to provide a clear view of a design detail.

In the case of the exemplary embodiment of FIGS. 4 and 5, a wedge mechanism is provided as a movement mechanism. A wedge 94 passes through a pair of oblong holes 96, which are provided in the two perpendicular walls 26 and 27 of the first arm 4. In the case of this exemplary embodiment, as well, a slanted-surface guide 92 is provided, this time between the vertex-side end face of the second arm 6 and a region of the first arm 4 that is situated in the region of the vertex 10. The first slanted surface 100 of the slanted-surface guide 92 on the second arm 6 and the second slanted surface 102 of the slanted-surface guide 92 on the first arm 4 both run essentially from left to right in FIG. 5. Here, too, each of the slanted surfaces 100 and 102, to state it precisely, is composed of two partial slanted surfaces, as in the case of the exemplary embodiment of FIGS. 2 and 3.

The wedge 94 has a first edge 104, which lies against the outer side 29 of the second arm 6 over part of its length. The wedge 94 furthermore has a second edge 106, which runs at a slant relative to the first, and interacts with the left front end of the pair of oblong holes 96. When the wedge 94 is driven further into the pair of oblong holes 96 in the direction toward the left top in FIG. 5, the first arm 4 is moved in the direction toward the vertex 10; this movement is necessarily accompanied by a movement of the first arm 4 transverse to its longitudinal expanse.

The exemplary embodiment of FIGS. 4 and 5 also has an encompassing component 108, which is U-shaped in this case. The encompassing component 108 is firmly welded onto the first arm 4, protects the slanted-surface guide 92, represents a guide for the first arm 4 during its combined longitudinal and transverse movement, and produces a rigid connection, which allows relative movement, between the first arm 4 and the second arm 6.

Aside from the differences between the exemplary embodiment of FIGS. 2 and 3 and the exemplary embodiment of FIGS. 4 and 5 described above, the holders 2 of the two exemplary embodiments are configured the same.

Figure 8:
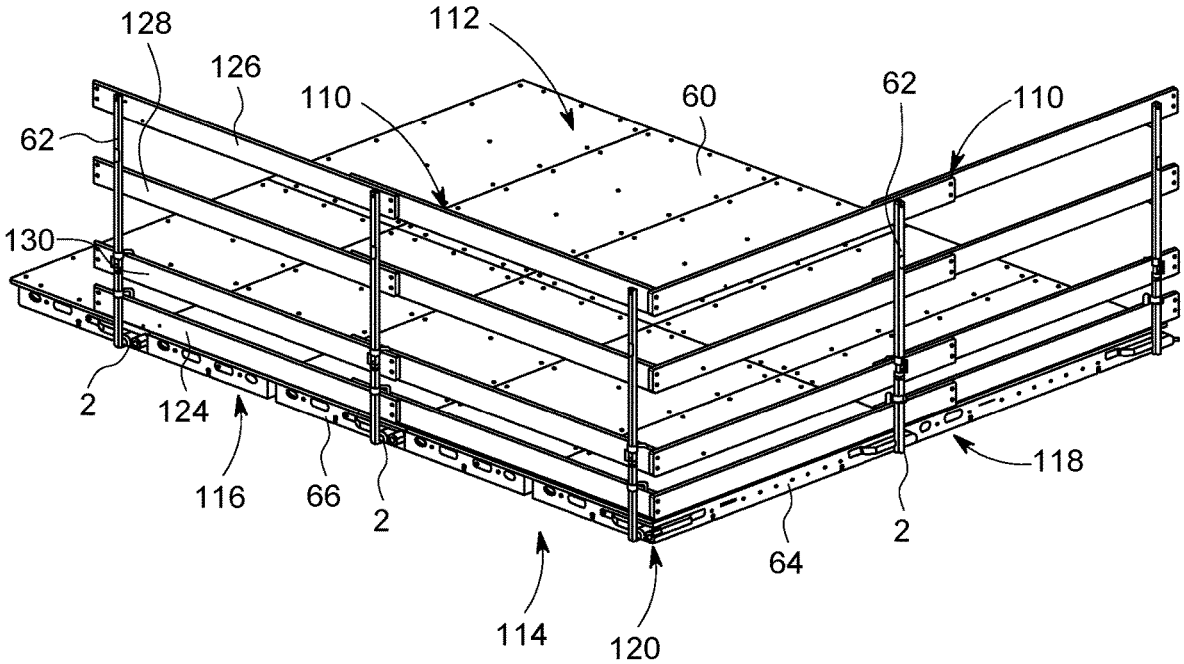
FIG. 8 a partial region of a ceiling formwork with a railing installed along the edge of the ceiling formwork, in a perspective representation.

In FIG. 8, it is shown what a railing 110 looks like, which is affixed to an edge 114 of a ceiling formwork 112 that goes around a 90° corner 120, by means of holders 2 according to the invention. The corner region of the ceiling formwork 112 that is shown has ten ceiling formwork panels 60, each of which has a top view surface size of 2 m×1 m, for example. On the part 116 of the edge 114 of the ceiling formwork 112 that runs from top left to bottom right in FIG. 8, the outer sides of five transverse edge supports 66 of five panels 60 can be seen. On the part 118 of the edge 114 of the ceiling formwork 112 that runs from bottom left to top right, two longitudinal edge supports 64 of two panels 60 can be seen. At the corner 120 of the ceiling formwork 112, i.e. at the corner 80 located there, of the panel 60 located there, a first holder 2 is affixed in such a manner as described in connection with FIG. 1. Along the left edge part 116, further holders 2 are affixed on panels 60, each at a reciprocal distance of two panel widths. Further holders 2 are also affixed on panels 60 in the right edge part 118, at a reciprocal distance of one panel length. It can be seen that—except at the ceiling formwork corner 120—the holders 2 each lie against the relevant ceiling formwork edge 114 on the outside with one of the two arms 4 and 6, but go into the space between two adjacent panels 60, in concrete terms into the space between the crosspieces 78 of two adjacent longitudinal edge supports 64 or two adjacent transverse edge supports 66, with the other arm, in each instance.

In FIG. 8, holders 2 having the design according to FIGS. 4 and 5 are shown. Alternatively, holders 2 according to the design of FIG. 1 or according to the design of FIG. 2, 3 can be used.

In FIG. 8, it can be seen that the part of the railing 110 shown has four sections, one between two adjacent holders 2 or railing posts 62, in each instance. In each section, four securing elements having a longitudinal expanse are held on the railing holders 12 or railing posts 62 are held, one on top of the other, wherein each of the securing elements, except for a section following the ceiling formwork corner 120, is held on two adjacent railing holders 12 or railing posts 62 at its end regions. To hold the securing elements, bracket holders 122 (see FIGS. 6 and 7) are present, in a usual manner.

Per section of the railing 110, a toe board 124 is provided at the very bottom, a guard rail 126 is provided at the very top, and two intermediate rails 128, 130 are provided in between, one on top of the other.

The invention claimed is:

1. A holder for holding an object on a formwork panel wherein the holder is configured for being affixed to the formwork panel, and the formwork panel has two longitudinal edge supports and two transverse edge supports, wherein the holder has a first arm that is configured for engaging with a longitudinal edge support of the formwork panel and a second arm that extends transverse to the first arm, forms an angle space together with the first arm, and is configured for engaging with a transverse edge support of the formwork panel, wherein the first arm has a first projection for being introduced into an opening of the longitudinal edge support on its side facing the angle space, and the second arm has a second projection for being introduced into an opening of the transverse edge support on its side facing the angle space;

and that the holder has a movement mechanism with which the projection of one of the two arms can be moved in the direction toward the other of the two arms, so as to tighten the holder, wherein the first arm and the second arm are tubular over a majority of their length.

2. The holder according to claim 1, wherein the movement mechanism is configured in such a manner that the projection of the said one of the two arms can be moved relative to the said one of the two arms, using the movement mechanism, or is configured in such a manner that the said one of the two arms can be moved together with the projection, using the movement mechanism.

3. The holder according to claim 1, wherein the projection of the said one of the two arms and/or the projection of the other of the two arms is/are configured as a rear engagement projection, for engaging behind the edge of the opening into which it is introduced.

4. The holder according to claim 1, wherein at least one of the two arms has a further projection for engaging with the relevant edge support, wherein the projection of the said one of the two arms and the further projection of the said one of the two arms are provided on longitudinal positions of the said one of the two arms that are spaced apart from one another.

5. The holder according to claim 4, wherein the further projection is configured to: a) be received by the opening of the relevant edge support, or b) be received by a further opening of the relevant edge support.

6. The holder according to claim 1, wherein the first projection has a first region on a side facing away from a free end of the first arm such that the first region is adapted to be received by an outer edge of the opening in the longitudinal edge support; and/or wherein the second projection has a second region on a side facing away from a free end of the second arm such that the second region is adapted to be received by an outer edge of the opening in the transverse edge support.

7. The holder according to claim 1, wherein the movement mechanism is a screw-thread mechanism or a wedge mechanism.

8. The holder according claim 1, wherein the second arm, is connected with a holder by way of a slanted-surface guide, such that tightening of the movement mechanism additionally forces said second arm to perform a movement that is directed transverse to the longitudinal extent of said second arm.

9. The holder according to claim 1, wherein the first arm and the second arm are in the form of a square tube.

10. The holder according to claim 1, further comprising: a railing post or a device for affixing a railing post integrated into the holder.

11. A railing arrangement on a ceiling formwork, the railing arrangement having at least one railing holder according to claim 1 affixed to a formwork panel, and multiple securing elements are longitudinally spaced one above another.

12. The railing arrangement according to claim 11, wherein the at least one railing holder has a tubular component into which a railing post is pushed with part of its length, and that at least a partial number of the securing elements is held on the railing post.

13. An arrangement that has a formwork panel having two longitudinal edge supports and two transverse edge supports, the formwork panel having a holder according to claim 1 affixed on it.

14. A holder for holding an object on a formwork panel, comprising:

a first arm configured for engaging with a longitudinal edge support of the formwork panel, the first arm comprising a first projection configured for introduction into an opening of the longitudinal edge support on a side of the first arm facing an angle space, wherein the first arm is tubular over a majority of a length of the first arm;

a second arm extending transverse to the first arm such that the first arm and the second arm define the angle space, the second arm comprising a second projection configured for introduction into an opening of a transverse edge support of the formwork panel on a side of the second arm facing the angle space, wherein the second arm is tubular over a majority of a length of the second arm;

a movement mechanism configured to move with at least one of the first projection of the first arm or the second projection of the second arm toward an other of the first arm or the second arm so as to tighten the holder.

15. The holder of claim 14, wherein at least one of the first arm and the second arm comprises a square tube.

16. The holder of claim 14, wherein each of the first arm and the second arm comprise a square tube.

17. A holder for holding an object on a formwork panel, comprising:

a first arm configured for engaging with a longitudinal edge support of the formwork panel, the first arm comprising a first projection configured for introduction into an opening of the longitudinal edge support on a side of the first arm facing an angle space, wherein the first arm is tubular over a majority of a length of the first arm;

a second arm extending transverse to the first arm such that the first arm and the second arm define the angle space, the second arm comprising a second projection configured for introduction into an opening of a transverse edge support of the formwork panel on a side of the second arm facing the angle space, wherein the second arm is tubular over a majority of a length of the second arm;

a movement mechanism configured to move with the first projection of the first arm toward the second arm so as to tighten the holder.

18. The holder of claim 17, wherein at least one of the first arm and the second arm comprises a square tube.

19. The holder of claim 17, wherein each of the first arm and the second arm comprise a square tube.

20. The holder of claim 17, wherein the movement mechanism is configured such that: the first projection moves relative to the first arm; or the first projection moves together with the first arm.

* * * * *